US005094398A

United States Patent [19]

Jeter et al.

[11] Patent Number: 5,094,398

[45] Date of Patent: Mar. 10, 1992

[54] QUICK-ADJUSTING, MULTIPLE DISPENSER POSITIONER

[75] Inventors: David R. Jeter, Woodstock; John T. Walsh, Duluth, both of Ga.

[73] Assignee: Nordson Corporation, Westlake, Ohio

[21] Appl. No.: 582,252

[22] Filed: Sep. 13, 1990

[51] Int. Cl.[5] ..... B05B 15/08

[52] U.S. Cl. ..... 239/134; 239/135; 239/587.2

[58] Field of Search ..... 239/133, 134, 135, 587

[56] References Cited

U.S. PATENT DOCUMENTS

| | | | |
|---|---|---|---|
| Re. 27,865 | 1/1974 | Baker et al. | 239/551 |
| 2,492,526 | 12/1949 | Geibig | 239/587 |
| 3,570,725 | 3/1971 | Baker et al. | 239/551 |
| 4,543,909 | 10/1985 | Sharpless | 239/587 |
| 4,616,782 | 10/1986 | Marietta et al. | 239/752 |
| 4,704,985 | 11/1987 | Rubinstein | 118/316 |
| 4,721,252 | 1/1988 | Colton | 239/135 |
| 4,785,996 | 11/1988 | Ziecker et al. | 239/135 |

*Primary Examiner*—Andres Kashnikow
*Assistant Examiner*—Karen B. Merritt
*Attorney, Agent, or Firm*—Wood, Herron & Evans

[57] ABSTRACT

An apparatus for adjusting the relative position of two or more material dispensers comprises a first module adapted to connect to a source of material, and a second module which is axially movable with respect to the first module. The first and second modules each mount at least one material dispenser such that a material passageway formed in each module is connected to a discharge bore formed in each material dispenser. The passageways in the first and second modules, in turn, are interconnected by a pair of pivot arms arranged in a scissors-like configuration which extend between the modules, and are movable between an extended and retracted position in response to movement of the second module, so that each dispenser can be supplied with material from a single supply line.

10 Claims, 3 Drawing Sheets

QUICK-ADJUSTING, MULTIPLE DISPENSER POSITIONER

FIELD OF THE INVENTION

This invention relates to equipment for positioning material dispensers, and, more particularly, to an apparatus carrying at least two dispensers supplied with material from a single feed line wherein the position of at least one of the dispensers is quickly and easily adjusted with respect to the other dispenser.

BACKGROUND OF THE INVENTION

Many applications require the use of multiple dispensers positioned at different locations relative to an article of given size which discharge adhesives, paint, powder coatings or other materials onto the article. For example, hot melt adhesive dispensers are employed in the cartoning and packaging industry to assemble the cartons or packages, and to adhere objects to the exterior of such packages. In one particular application, water-tight cardboard boxes for various beverages are assembled with hot melt adhesive, and then a pattern of three dots of adhesive is applied to the outside of the water-tight box to secure a straw thereto for use in drinking the beverage from the container In this application, and other cartoning applications, it is desirable to have the capability of accommodating boxes of different height with a minimum of down time of the cartoning line. In order to properly position the dots on the exterior of the water-tight cardboard box in the above-described example, the position of the adhesive dispensers must be adjusted to a height corresponding to that of the box and the straw sized for use with such box.

Positioners which are capable of adjusting the location of adhesive dispensers with respect to an article such as a box or package are well known and widely used in industry. One problem with many positioners for dispensers is that they are capable of handling one or more adhesive dispensers each having its own adhesive supply line, temperature control equipment and operating air lines. In the application described above, a total of three adhesive dispensers and associated adhesive supply lines and air lines are required to apply the desired pattern of dots to the water-tight carton. In this and many other cartoning and packaging applications, the space available for heated hot melt adhesive supply lines and/or air control lines is very limited, and separate supply lines for each adhesive dispenser is unacceptable

SUMMARY OF THE INVENTION

It is therefore among the objectives of this invention to provide an apparatus for adjusting the position of two or more dispensers relative to one another which provides for quick and easy adjustment of the relative position of the dispensers which is compact in construction, which employs a single material supply line and which is substantially leak free during adjustment and operation.

These objectives are accomplished in an apparatus for positioning two or more dispensers for hot melt adhesive, or other materials, comprising a first module adapted to connect to a source of adhesive, and a second module which is axially movable with respect to the first module. The first and second modules each mount at least one adhesive dispenser such that an adhesive passageway formed in each module is connected to a discharge bore formed in each adhesive dispenser The adhesive passageways in the first and second modules, in turn, are interconnected by a pair of pivot arms arranged in a scissors-like configuration which extend between the modules and are movable between an extended and retracted position in response to movement of the second module.

This invention is predicated upon the concept of permitting adjustment of the relative position of multiple adhesive dispensers while supplying all of the dispensers with hot melt adhesive or other material from a single supply line. This is achieved by the pivot arms which interconnect the first and second modules, wherein each pivot arm is formed with a connector passage providing a flow path for the adhesive from the first module connected to a single adhesive supply line, to the second module. This configuration permits quick and easy adjustment of the relative location of the adhesive dispensers carried on the two modules so that the location of the adhesive discharged therefrom can be varied as required.

In the presently preferred embodiment, the dispenser positioner apparatus of this invention includes a fixed module which mounts a first adhesive dispenser and a movable module which mounts two adhesive dispensers side-by-side. Both the fixed and movable modules are carried on a slider rod, and the movable module is formed with a throughbore to receive the slider rod and permit axial movement therealong. In order to effect movement of the movable module along the slider rod, a partially threaded shaft extends between a bore formed in the fixed module and a nut carried by the movable module. Rotation of the shaft causes the movable module to slide toward or away from the fixed module upon the slider rod, and thus position the side-by-side dispensers carried by the second module at the desired location relative to the dispenser mounted to the first module.

With the modules adjusted to the desired relative position, adhesive from a single supply line is introduced into the adhesive passageway formed in the fixed module. This adhesive passageway connects to the adhesive dispenser carried by the fixed module, and is also directed into the connector passage of one of the pivot arms. The adhesive is transmitted along such pivot arm, through a pivotal connection joining the two pivot arms and then into the connector passage of the other pivot arm which is connected to the movable module. The adhesive passageway in the movable module receives the adhesive from the connector passage in the pivot arm and transmits it to each of the two adhesive dispensers carried on a movable module. Preferably, the pivotal connections between the pivot arms and modules, and between the two pivot arms themselves, are made by pivotal elements such as plugs or connectors having O-rings which seal such pivotal connections against leakage. Adhesive is thus transmitted from a single supply line to both of the modules and all of the adhesive dispensers regardless of the relative position of the movable module and fixed module, and their associated dispensers.

Another important aspect of this invention is that the two modules and their associated pivot arms are all heated by a single cartridge heater carried in the slider rod. Each module is mounted to the slider rod, and the pivot arms are connected to the modules such that a large surface area of contact is provided therebetween.

A heat transfer path is thus created from the slider rod, through the modules and to the pivot arms which transmits sufficient heat to each element to maintain hot melt adhesive transmitted between the modules at the desired temperature.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
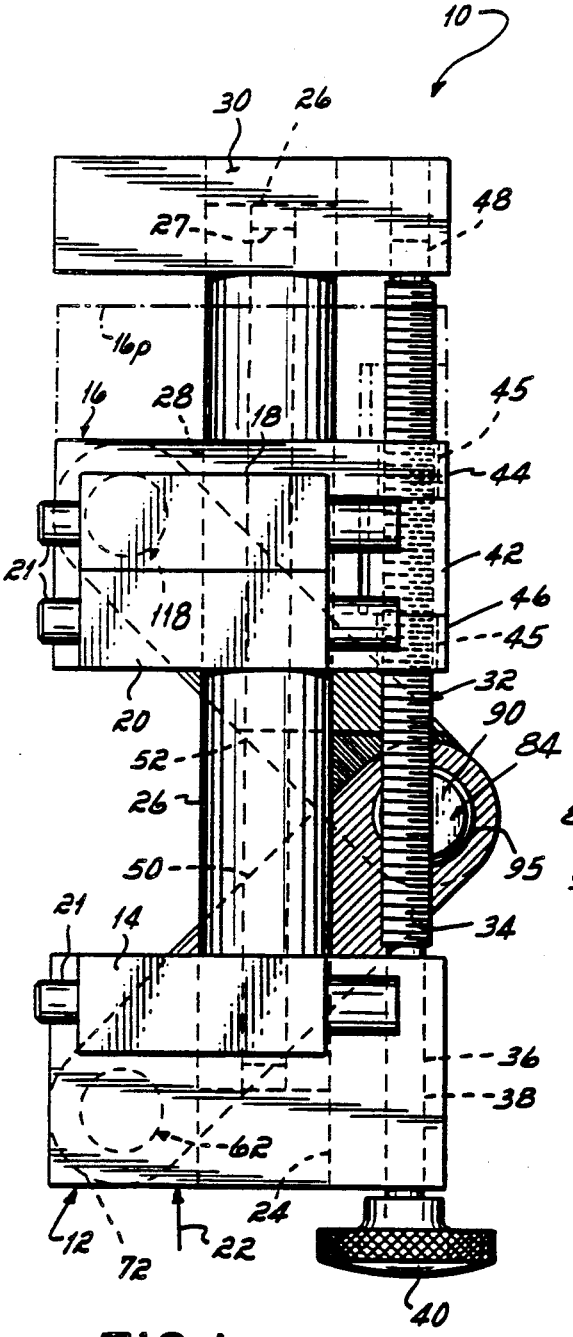
FIG. 1 is a front view of the apparatus herein in which the modules are shown in a partially retracted position.

Referring now to the FIGS., a multiple dispenser positioner 10 is illustrated comprising a fixed module 12 which mounts an adhesive dispenser 14, and a movable module 16 which mounts two adhesive dispensers 18, 20 side-by-side. The movable module 16 is axially movable toward and away from the fixed module 12. Structure is provided to effect such axial movement of module 16, and to permit the transmission of adhesive between the fixed and movable modules 12, 16 so that a single adhesive supply line 22 connected to the fixed module 12 can be employed to supply adhesive to all of the dispensers 14, 18 and 20. The module adjustment structure and adhesive flow paths are described separately below.

Adjustment Structure

Figure 2:
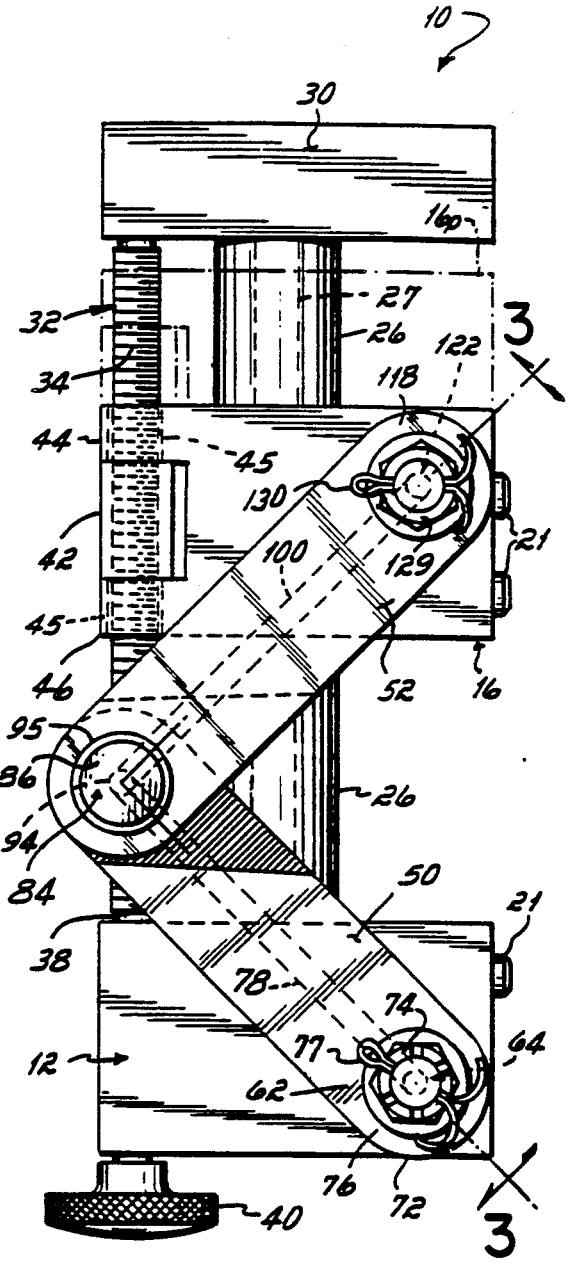
FIG. 2 is a rear view of the apparatus shown in FIG. 1.

In the presently preferred embodiment, the fixed module 12 has a bore 24 which receives a relatively large diameter slider rod 26 fixedly mounted thereto. This slider rod 26 extends through a throughbore 28 formed in the movable module 16, and then into a support block 30 wherein the slider rod 26 is fixed in place. A cartridge heater 27 is carried within the slider rod 26 to provide heat to the modules 16, 16, as described more fully below. The movable module 16 is illustrated in an intermediate position and is axially slidable along the slider rod 26 between a retracted position (not shown) in FIGS. 1 and 2, and an extended position (see phantom lines **16*p***).

The movable module 16 is slid along the slider rod 26 by operation of a shaft 32 formed with external threads 34 along a portion thereof. The fixed module 12 is formed with a throughbore 36 which receives an unthreaded portion 38 of shaft 32 terminating with flats (not shown) which mount a knob 40. The portion of shaft 32 formed with threads 34 extends into a nut 42 carried between a pair of flanges 44, 46 formed in the movable module 16. Each flange 44, 46 is formed with a throughbore 45 to permit passage of the shaft 32 therethrough. The threaded portion 34 of shaft 32 extends through the bore 45 in the flange 44 into the support block 30 where it is carried in a journal 48.

In response to rotation of the shaft 32, the movable module 16 is moved along the shaft 32 and slider rod 26 toward or away from the fixed module 12 depending upon the direction of rotation of shaft 32. The relative spacing between the adhesive dispenser 14 carried on the fixed module 12, and the adhesive dispensers 18, 20 carried on the movable module 16, is thus variable as required in a particular application.

Adhesive Flow Path

As mentioned above, an important aspect of this invention is the provision of structure capable of transmitting adhesive between the fixed module 12 and movable module 16 from a single adhesive supply line 22 throughout the movement of the movable module 16 between an extended and retracted position. This flow path is formed by adhesive passageways in both the fixed module 12 and movable module 16, described below, and connector passages formed in a pair of pivot arms 50 and 52 which are pivotally interconnected to one another and to the fixed and movable modules 12, 16, respectively.

With reference to FIGS. 2–7, and FIG. 3 in particular, the adhesive flow path through the fixed module 12 into pivot arms 50 and 52 is illustrated. Preferably, the fixed module 12 is formed with an adhesive inlet 54 connected to the adhesive supply line 22 from a source of adhesive 23. The adhesive inlet 54 is connected to a first passageway 56 which transmits adhesive to the adhesive dispenser 14. The adhesive dispenser 14, as well as dispensers 18, 20, form no part of this invention per se and are of the type disclosed, for example, in U.S. Pat. No. 4,785,996, owned by the same assignee as this invention, the disclosure of which is incorporated by reference in its entirety herein. Each dispenser 14, 18 and 20 has a discharge passage (not shown) connected to a nozzle 21 having a discharge outlet 25, and are supplied with operating air through an air passage 27 formed in each module 12, 16 connected to a source of pressurized air (not shown). See FIGS. 6 and 7.

The fixed module 12 is formed with a stepped bore 58 connected to an L-shaped second passageway 60 which extends to the adhesive inlet 54. This stepped bore 58 has a threaded portion which mounts a pivot plug 62 having an internal bore 64 which is generally L-shaped defining a longitudinal portion 66 and a transverse portion 68 as viewed in the FIGS. The transverse portion 68 of internal bore 64 terminates within an annular groove 69 formed in the outer end of pivot plug 62. An inner O-ring 70 is carried on the inner end of pivot plug 62 upstream from second passageway 60, and a pair of O-rings 71 are carried on the outer portion of pivot plug 62 on either side of annular groove 69.

Figure 3:
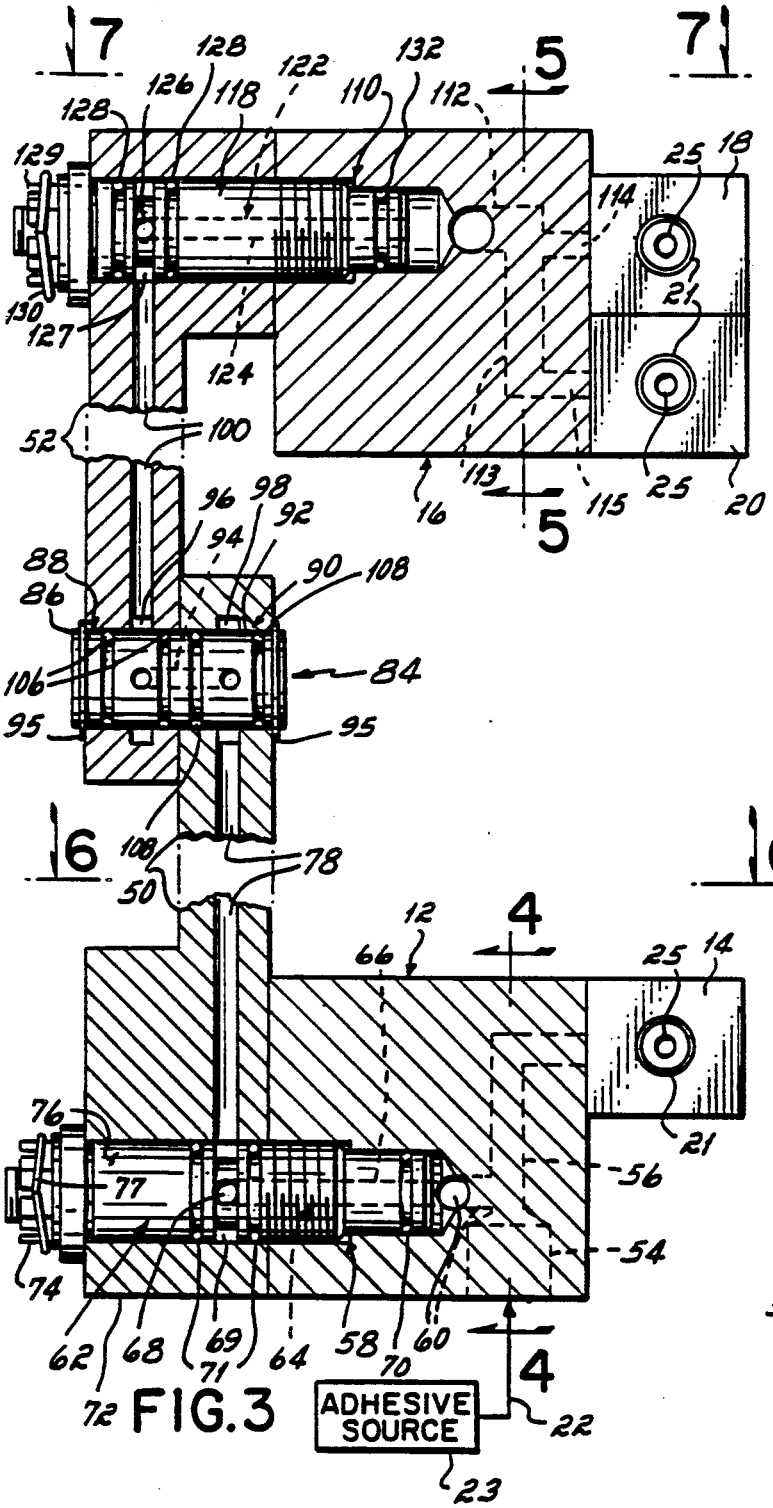
FIG. 3 is a cross sectional view of the adhesive flow path between the modules and pivot arms taken generally along line 3—3 of FIG. 2.
Figure 5:
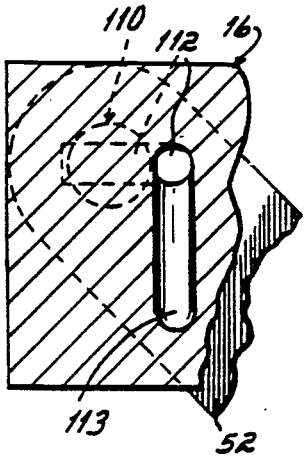
FIG. 5 is a cross sectional view of the adhesive passageway in the movable module, taken generally along line 5—5 of FIG. 3.
Figure 4:
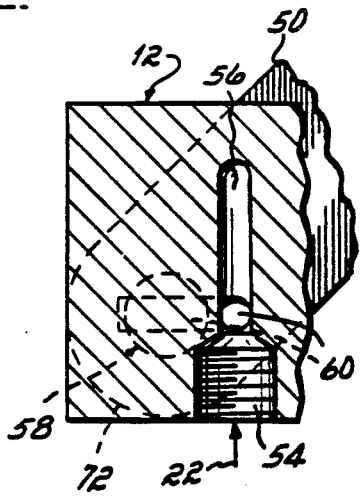
FIG. 4 is a cross sectional view of the adhesive passageway in the fixed module, taken generally along line 4—4 of FIG. 3.
Figure 6:
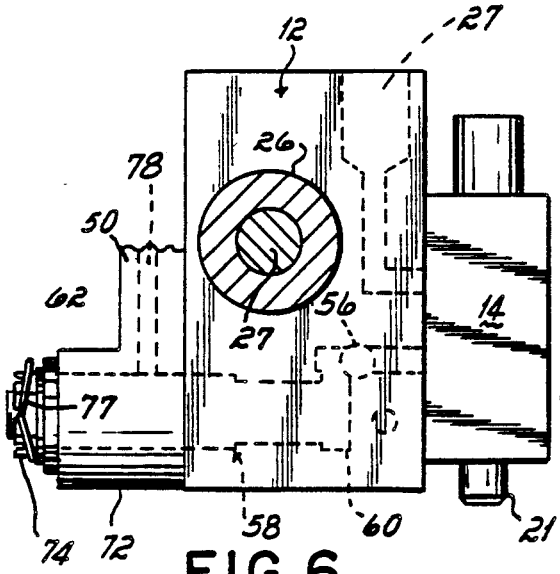
FIG. 6 is an elevational view of the fixed module herein as seen generally along line 6—6 of FIG. 3.

As illustrated in FIG. 3, the outer portion of pivot plug 62 mounts the lower end 72 of pivot arm 50 so that the pivot arm 50 is pivotal with respect to the fixed module 12. A castle nut 74 is threaded onto the outermost end 76 of pivot plug 62, and retained thereon by a cotter pin 77, to mount the pivot arm 50 upon the pivot plug 62. As shown in FIG. 3, the pivot plug 62 is positioned with respect to the pivot arm 50 such that a connector passage 78 formed in the pivot arm 50 aligns with the annular groove 69 in the pivot plug 62. An adhesive flow path is therefore formed through the fixed module 12 into the pivot arm 50 defined by the adhesive inlet 54, a portion of passage 56 and second passageway 60 within the fixed module 12, the internal bore 64 and annular groove 69 in the pivot plug 62 and the connector passage 78 in the pivot arm 50. Because of the O-rings 70 and 71 carried by the pivot plug 62, rotation of the pivot arm 50 with respect to the fixed module 12 is permitted without any leakage of adhesive from the above-defined adhesive flow path.

Referring again to FIG. 3, an adhesive flow path is illustrated from the pivot arm 50, through the pivot arm 52 and then into the movable module 16. As viewed at the middle portion of FIG. 3, the pivot arms 50, 52 are interconnected by a pivot arm connector 84. The pivot arm connector 84 has an outer portion 86 which is received within a throughbore 88 formed in pivot arm 52. The pivot arm connector 84 is also formed with an inner portion 90 which is received within a throughbore 92 formed in the pivot arm 50. In the assembled position shown in FIG. 3, the pivot arms 50, 52 are pivotal upon the connector 84 and are retained thereon by snap rings 95 located on opposite ends of the connector 84.

In the presently preferred embodiment, the connector 84 is formed with an internal passage 94 having one end connected to an annular, recessed groove 96 formed in the pivot arm 52, and an opposite end connected to an annular, recessed groove 98 formed in the pivot arm 50. The annular groove 96 in pivot arm 52 communicates with a connector passage 100 formed therein, and the annular groove 98 formed in pivot arm 50 communicates with the connector passage 78 formed therein. A pair of O-rings 106 are carried by the pivot arm connector 84 on either side of the annular groove 96 and connector passage 100, and a second pair of O-rings 108 are located on either side of the annular groove 98 and connector passage 78. This provides a leak-proof seal between the pivot arms 50, 52 at the connector 84.

Figure 7:
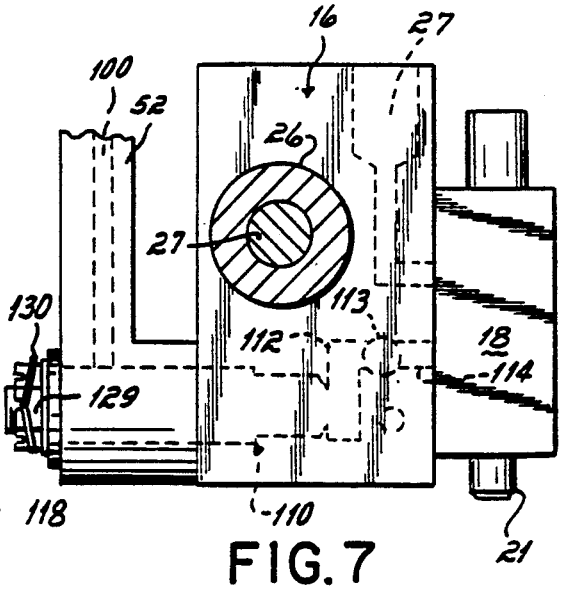
FIG. 7 is an elevational view of the movable module of this invention as seen generally along line 7—7 of FIG. 3.

With reference to the top portion of FIG. 3 and FIG. 7, the movable module 16 is formed with a stepped bore 110 which is joined to a bore 112 connected to a U-shaped transfer passage 113 having a first leg 114 which transmits adhesive to the adhesive dispenser 18, and a second leg 115 which transmits the adhesive into the other adhesive dispenser 20.

Adhesive is transmitted from the pivot arm 52 into the movable module 16 to bore 112 through a pivot plug 118 which is threaded into the stepped bore 110 of movable module 16. The pivot plug 118 is formed with an internal bore 122 having a longitudinal portion 124 connected to the stepped bore 110, and a transverse portion 126 which terminates at an annular groove 127 formed in the outer portion of pivot arm 52. The upper end of pivot arm 52 as viewed in FIG. 3 is pivotally mounted on the outer portion of pivot plug 118, and retained thereon by a castle nut 129 and cotter pin 130, such that the connector passage 100 in pivot arm 52 aligns with the annular groove 127 formed in the pivot plug 118. A pair of O-rings 128 are located on either side of the connection between connector passage 100 and the annular groove 127 to provide a seal therebetween. Additionally, an O-ring 132 is carried on the inner end of pivot plug 118 within the stepped bore 110 of movable module 16 upstream from the bore 112 to provide a seal thereat. A substantially leak-free adhesive flow path is thus provided from the pivot arm connector 84, through the pivot arm 52 and movable module 16, to each of the dispensers 18, 20 for discharge onto a substrate.

An important aspect of this invention is to maintain the hot melt adhesive at the desired temperature throughout its passage through the above-described adhesive flow path, without requiring the use of heaters and associated electrical wiring in either of the modules 12, 16 or the pivot arms 50, 52. This is accomplished herein by providing a large diameter, stationary slider rod 26 having a cartridge heater 27 which is effective to heat the slider rod 26 to a relatively high temperature. Heat from the slider rod 26 is transmitted directly to each of the modules 12 and 16 connected thereto which eliminates the need for separate heaters in such modules 12, 16. In addition, as shown in FIG. 3, the pivot plugs 62 and 118 which pivotally mount pivot arms 50 and 52 to modules 12 and 16, respectively, are each located at the far corner of such modules 12, 16. This ensures that each pivot arm 50 and 52 has a relatively large surface area of contact with modules 12, 16, respectively, to obtain good heat transfer therebetween. As a result, the cartridge heater 27 in slider rod 26 effectively heats modules 12, 16 and pivot arms 50, 52 so that the temperature of the hot melt adhesive is maintained in the course of its passage from module 12, to module 16.

Operation

Figure 8:
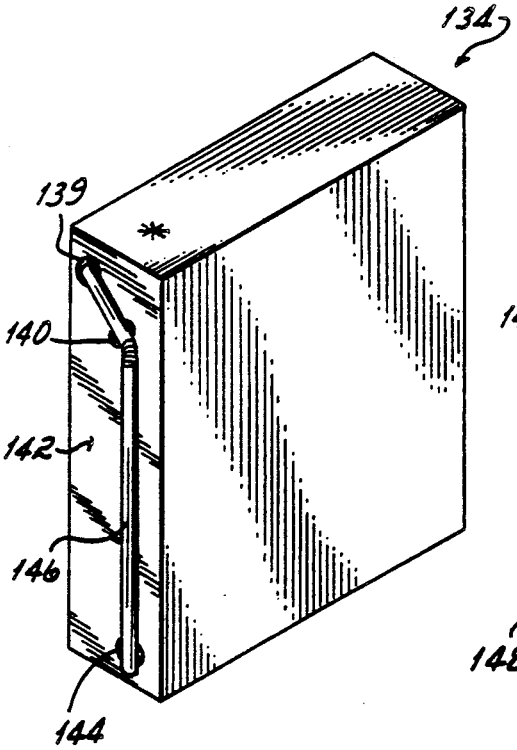
FIG. 8 is a schematic view of a small, water-tight cardboard box having a pattern of adhesive applied by the apparatus of this invention for attaching a straw thereto.
Figure 9:
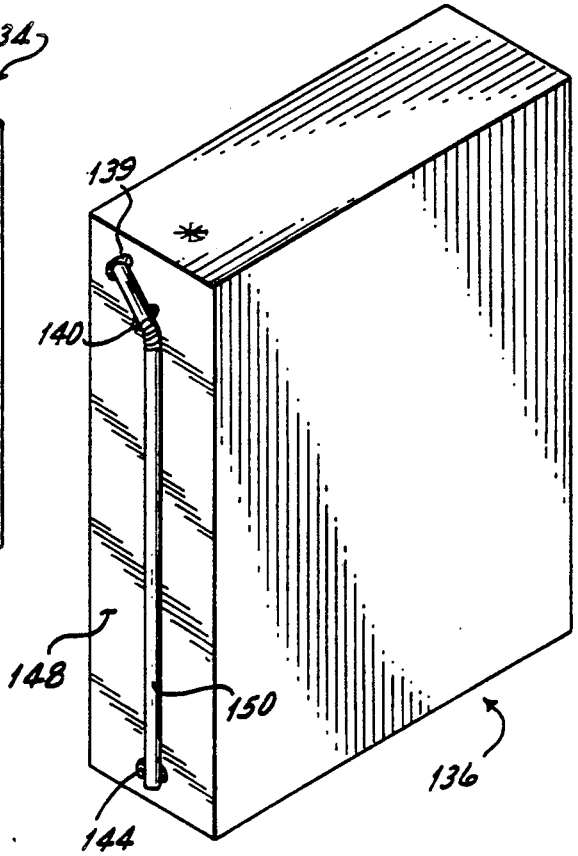
FIG. 9 is a view similar to FIG. 8 except with a larger water-tight cardboard box and straw.

The multiple gun positioner 10 of this invention is particularly useful in applications of the type illustrated in FIGS. 8 and 9 wherein an adhesive pattern must be supplied to boxes 134 and 136 of different height. As viewed in FIG. 8, the box 134 is relatively short and requires the adhesive dispensers 18 and 20 carried on the movable module 16 to be located in a position to apply two adhesive dots 139 and 140 onto the top portion of the side edge 142 of box 134 while the dispenser 14 on the fixed module 12 applies an adhesive dot 144 onto the bottom of the side edge 142. This particular pattern of adhesive dots 139, 140 and 144 is intended to affix a plastic straw 146 to the exterior of box 134 which is later used to drink the liquid contents from the box 134.

In order to effect movement of the movable module 16 to a position for the application of adhesive dots 139 and 140, the shaft 32 is rotated to slide the movable module 16 along slider rod 26 until the discharge outlets 25 of adhesive dispensers 18, 20 are located at the appropriate position with respect to side edge 142 of box 134. Adhesive is transmitted into the fixed module 12 and transferred to the adhesive dispenser 14 thereon, and to the adhesive dispensers 18, 20 carried by the movable module 16, along the adhesive flow path through the modules 12, 16 and pivot arms 50, 52 described above.

In order to accommodate the taller box 136, the shaft 32 is rotated in a direction to slide the movable module 16 away from the fixed module 12 so that the adhesive dispensers 18, 20 are placed at the desired location relative to box 136. The adhesive dots 139 and 140 are applied at the appropriate position along the taller side 148 of box 136 in order to secure a large straw 150 thereto. The bottom adhesive dot 144 discharged from the dispenser 14 carried by fixed module 12 is located at essentially the same position on box 136 as on box 134. The adjustment of the position of dispensers 18, 20 is thus accomplished quickly and easily with the positioner 10 of this invention, and the desired pattern of adhesive dots is obtained from multiple adhesive dispensers 14, 18 and 20 supplied by a single adhesive supply line 22.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, relative movement of the fixed and movable modules 12, 14 is illustrated in the FIGS. as being effected by rotation of a threaded shaft 32. It is contemplated, however, that the movable module 16 could be slid along the slider rod 26 by essentially any means including pneumatic or hydraulic cylinders or the like. In this connection, it is also contemplated that the adhesive dispensers 18, 20 carried on the movable module 16 could be operated to discharge adhesive in the course of movement of the movable module 16 to obtain an elongated pattern of adhesive as opposed to the adhesive dots illustrated in the particular application of FIGS. 8 and 9.

In the embodiment of positioner 10 illustrated in the FIGS., the module 12 is fixed to the slider rod 26 whereas the module 16 is movable therealong. It is contemplated, however, that both modules 12, 16 can be moved toward and away from one another along the slider rod 26, if desired. The heated adhesive supply line 22 connected to the fixed module 12 is relatively flexible and can withstand at least some movement along the slider rod 26 if it was determined desirable to move both the module 12 and module 16. Moreover, the adhesive supply line 22 can be mounted to the movable module 16 or at a location along either of the pivot arms 50, 52, e.g., at the pivot arm connector 84, in order to supply adhesive to the dispensers 14, 18 and 20. It should also be understood that the number of adhesive dispensers illustrated in the FIGS. is intended for purposes of illustration only, and it is contemplated that essentially any number of dispensers could be employed as desired.

Therefore, it is intended that the invention not be limited to the particular embodiment disclosed as the best mode contemplated for carrying out this invention, but that the invention will include all embodiments falling within the scope of the appended claims.

We claim:

1. An apparatus for adjusting the relative position of material dispensers, comprising:

a first dispenser unit formed with a first material passageway having a discharge outlet for emitting material;

a second dispenser unit formed with a second material passageway having a discharge outlet for emitting material, said second dispenser unit being spaced from said first dispenser unit along an axis which extends between said first and second dispensers;

adjustment means for axially moving at least one of said first and second dispenser unit with respect to the other along said axis therebetween to vary said axial spacing between said first and second dispenser units;

material transfer means for transmitting material between said first and second material passageways, said material transfer means being connected to said first material transfer passageway of said first dispenser unit and to said second material passageway of said second dispenser unit so that said material transfer means is movable with at least one of said first and second dispensers in response to operation of said adjustment means, one of said first dispenser unit, second dispenser unit and material transfer means being adapted to connect to a source of material.

2. An apparatus for adjusting the relative position of material dispensers, comprising:

a first module which mounts a first dispenser having a discharge outlet, said first module being formed with a first material passageway connected to said first dispenser and being adapted to be connected to a source of material to be dispensed;

a second module which mounts a second dispenser having a discharge outlet, said second module being formed with a second material passageway connected to said second dispenser, said second module being spaced from said first module along an axis which extends between said first and second modules;

adjustment means for axially moving at least one of said first and second modules with respect to the other along said axis therebetween to vary the axial spacing of said discharge outlets of said first and second dispensers;

material transfer means interconnecting said first material passageway of said first module with said second material passageway of said second module and being movable with at least one of said first and second modules for transmitting material from said first module to said second module.

3. The apparatus of claim 2 in which said first module is fixedly mounted to a slider rod having a longitudinal axis and said second module is axially slidable along said slider rod, said adjustment means connected between said first and second modules is a shaft having one end carried by said first module and a second, threaded end matable with an internally threaded portion of said second module so that upon rotation of said threaded shaft said second module is moved along said shaft and along said longitudinal axis of said slider rod relative to said first module.

4. The apparatus of claim 3 in which said slider rod mounts a cartridge heater for heating said slider rod, said slider rod being effective to transfer heat to each of said first and second modules, which, in turn, transmit heat to said material transfer means.

5. The apparatus of claim 2 in which said material transfer means comprises:

a first pivot arm formed with a first connector passage, one end of said first pivot arm being pivotally mounted to said first module so that said first connector passage communicates with said first material passageway;

a second pivot arm formed with a second connector passage, one end of said second pivot arm being pivotally mounted to said second module so that said second connector passage communicates with said second material passageway;

means for pivotally interconnecting the opposite ends of said first and second pivot arms so that said connector passage in said first pivot arm communicates with said connector passage in said second pivot arm to form a flow path between said first material passageway in said first module and said second material passageway in said second module.

6. An apparatus for adjusting the relative position of material dispensers, comprising:

a first module which mounts a first dispenser having a discharge outlet, said first module being formed with a first material passageway connected to said first dispenser and being adapted to be connected to a source of material to be dispensed;

a second module with mounts a second dispenser having a discharge outlet, said second module being formed with a second material passageway connected to said second dispenser, said second module being spaced from said first module along an axis which extends between said first and second modules;

adjustment means for axially moving at least one of said first and second modules with respect to the other along said axis therebetween to vary the axial spacing of said discharge outlets of said first and second dispensers;

a material transfer mechanism including:

(i) a first pivot arm formed with a first connector passage;

(ii) a second pivot arm formed with a second connector passage;

(iii) means for pivotally connecting said first pivot arm to said first module so that said first connector passage in said first module communicates with said first material passageway in said first module;

(iv) means for pivotally connecting said second pivot arm to said second module so that said second connector passage in said second module communicates with said second material passageway in said second module;

(v) means for pivotally interconnecting said first and second pivot arms so that said first and second connector passages communicate with one another.

7. The apparatus of claim 6 in which said means for pivotally connecting said first pivot arm and said first module is a pivot plug mounted to said first module, said pivot plug being formed with an internal bore connected at one end to said first material passageway and at the other end to an annular groove formed in said pivot plug, said first pivot arm being pivotally mounted on said pivot plug so that said first connector passage in said first pivot arm is connected to said annular groove in said pivot plug.

8. The apparatus of claim 6 in which said means for pivotally connecting said second pivot arm and said second module is a pivot plug mounted to said second module, said pivot plug being formed with an internal bore connected at one end to said second material passageway and at the other end to an annular groove formed in said pivot plug, said second pivot arm being pivotally mounted on said pivot plug so that said second connector passage in said second pivot arm is connected to said annular groove in said pivot plug.

9. The apparatus of claim 6 in which said means for pivotally interconnecting said first and second pivot arms is a connector plug having a first end and a second end each formed with an internal bore, said first pivot arm being formed with a bore which receives said first end of said connector plug and a recessed groove which connects to said internal bore in said first end so that said first connector passage in said first pivot arm communicates with said internal bore in said first end of said connector plug, said second pivot arm being formed with a bore which receives said second end of said connector plug and a recessed groove which connects to said internal bore in said second end so that said second connector passage in said second pivot arm communicates with said internal bore in said second end of said connector plug.

10. The apparatus of claim 6 in which said first module is fixedly mounted to a slider rod having a longitudinal axis and said second module is axially slidable along said slider rod, said adjustment means connected between said first and second modules is a shaft having one end carried by said first module and a second, threaded end matable with an internally threaded portion of said second module so that upon rotation of said threaded shaft said second module is moved along said shaft and along said longitudinal axis of said slider rod relative to said first module.

* * * * *